US006381855B1

(12) United States Patent
Lin

(10) Patent No.: US 6,381,855 B1
(45) Date of Patent: May 7, 2002

(54) KNIFE-HOLDING ASSIST

(76) Inventor: Ching-Hsiung Lin, 4F-6, No. 157, Sec. 2 Fu-Hsing S. Rd., Taipei (TW)

( * ) Notice: Subject to any disclaimer, the term of this patent is extended or adjusted under 35 U.S.C. 154(b) by 0 days.

(21) Appl. No.: 09/838,113

(22) Filed: Apr. 20, 2001

(51) Int. Cl.[7] ..... B26B 29/00
(52) U.S. Cl. ..... 30/295; 30/286; D7/152
(58) Field of Search ..... 30/296.1, 298, 30/286, 295; D7/401.2

(56) References Cited

U.S. PATENT DOCUMENTS 492,409 A * 2/1893 May ..... 30/295
1,222,366 A * 4/1917 Curry ..... 30/286
1,750,577 A * 3/1930 Bracht ..... 30/295
2,650,424 A * 9/1953 Kalmon ..... 30/286
D255,974 S * 7/1980 Jacoby ..... D7/152

* cited by examiner

*Primary Examiner*—Hwei-Siu Payer
(74) *Attorney, Agent, or Firm*—Troxell Law Group PLLC

(57) ABSTRACT

Knife-holding assist including a blade-riding section and a grip section formed on two lateral sides of the blade-riding section. The blade-riding section has a U-shaped cross-section and includes a pair of opposite plate bodies integrally connected with each other. The plate bodies define a receiving channel, whereby a blade of the knife can be fitted into the receiving channel with the back edge of the blade abutting against the bottom of the receiving channel. The grip section includes two flat arched sections, whereby a user's hand can grip the grip section with the palm pressing an upper edge of the blade-riding section to facilitate cutting operation. The grip section also protects the fingers from slipping and getting hurt by the blade.

3 Claims, 2 Drawing Sheets

KNIFE-HOLDING ASSIST

BACKGROUND OF THE INVENTION

The present invention is related to a knife-holding assist having a blade-riding section for riding on the back edge of the blade and a grip section for a user's hand to grip to facilitate cutting operation.

When using a knife to cut a hard article, a user often presses the back edge of the blade of the knife with his/her palm for cutting off the article. In the case that the hand of the user is stained with oil or water, the hand is very likely to slip away from the back edge of the blade during cutting. This makes it difficult to cut the article and may lead to injury of the hand.

SUMMARY OF THE INVENTION

It is therefore a primary object of the present invention to provide a knife-holding assist including a blade-riding section and a grip section formed on two lateral sides of the blade-riding section. The blade-riding section can be fitted onto the back edge of the blade of the knife. The grip section includes two arched sections. A user's hand can grip the grip section with the palm pressing an upper edge of the blade-riding section to facilitate cutting operation. The fingers of the user can extend into the arched sections of the grip section so that the fingers are protected from slipping and getting hurt by the blade during cutting.

The present invention can be best understood through the following description and accompanying drawings wherein:

DETAILED DESCRIPTION OF THE PREFERRED EMBODIMENT

Figure 1:
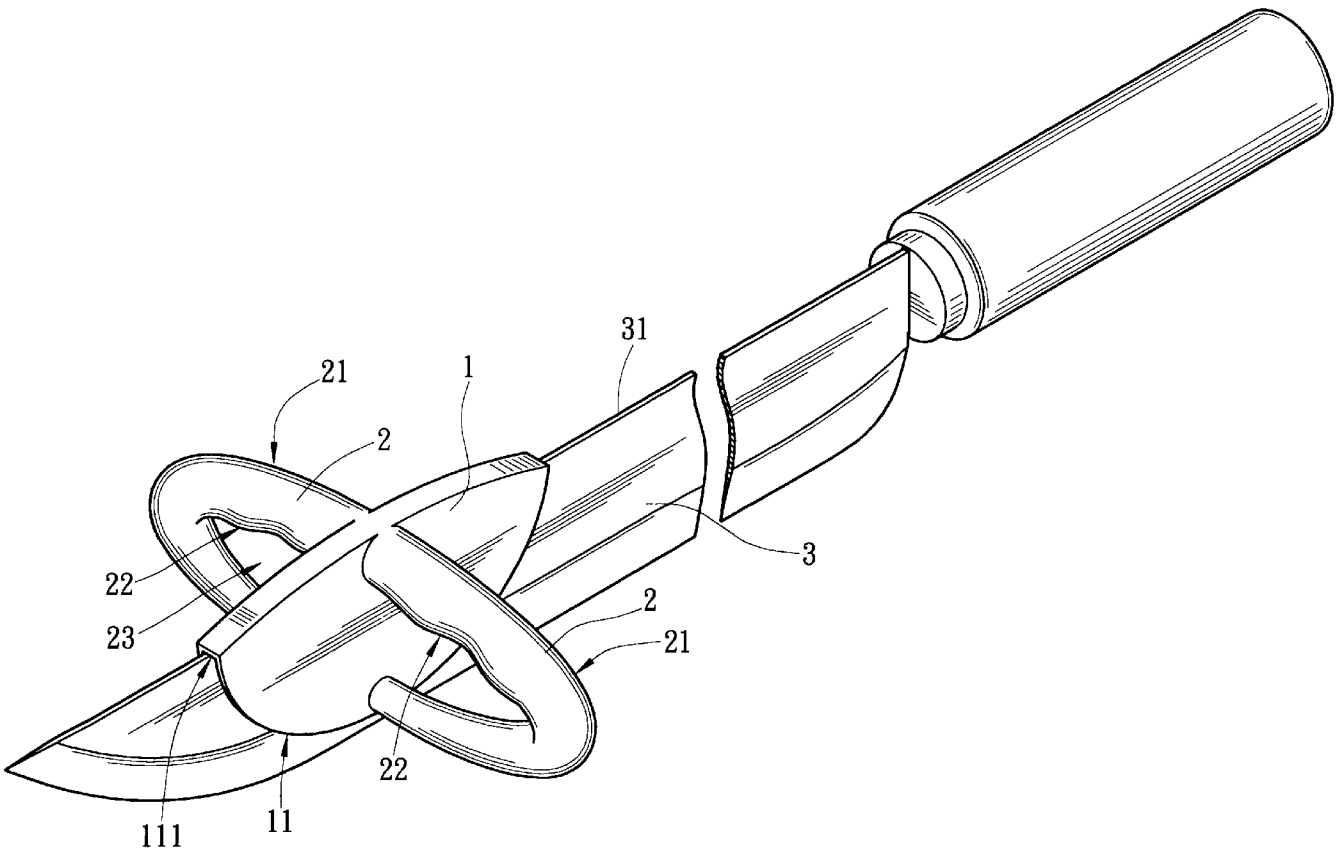
FIG. 1 is a perspective view of the present invention fitted on the back edge of a blade.
Figure 2:
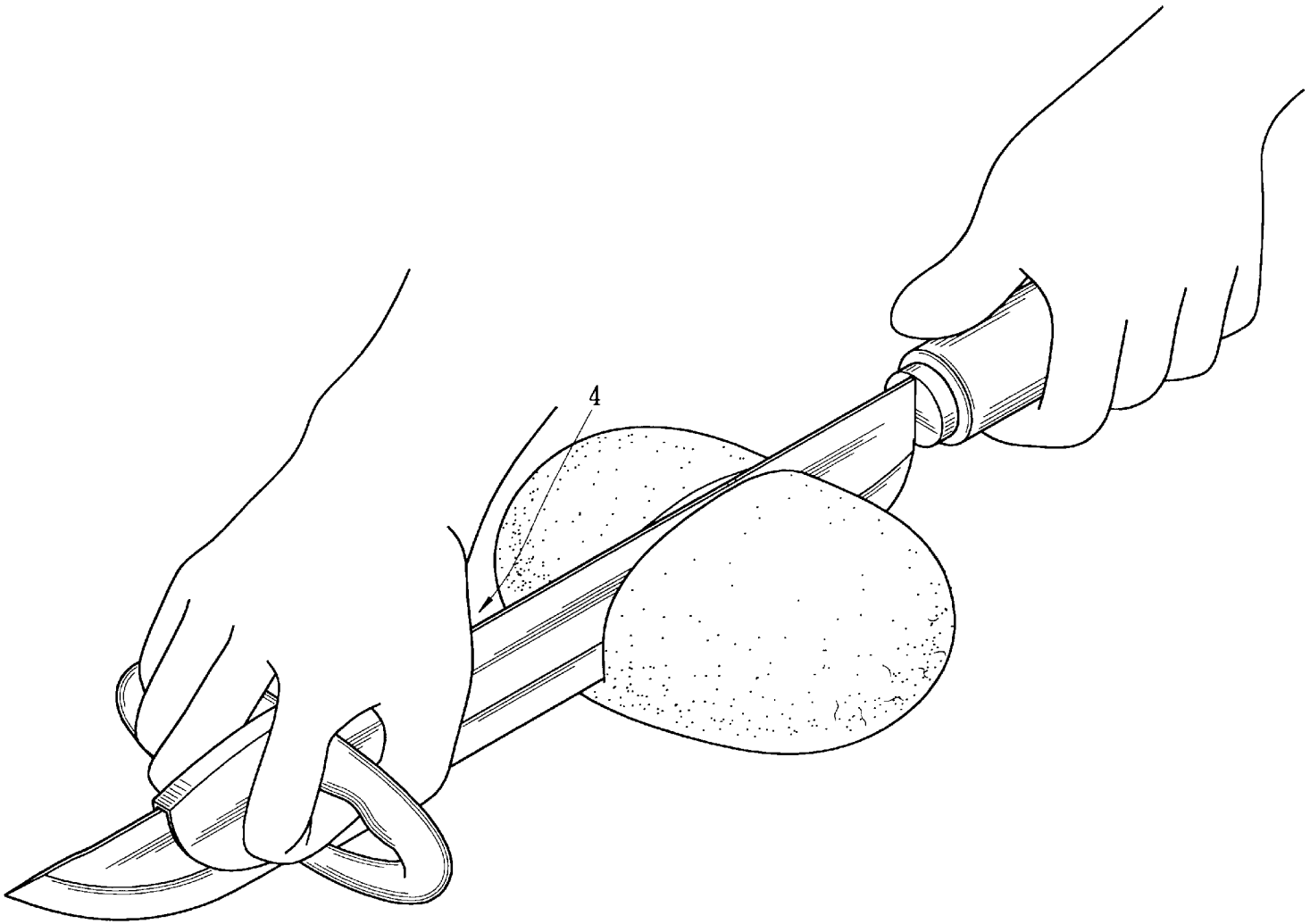
FIG. 2 is a perspective view according to FIG. 1, showing the use thereof.

Please refer to FIGS. 1 and 2. The knife-holding assist 4 of the present invention includes a blade-riding section 1 and a substantially ring-shaped grip section 2 formed on two lateral sides of the blade-riding section 1. The blade-riding section 1 has a U-shaped cross-section, including a pair of opposite plate bodies connected with each other by a stop wall 111. The plate bodies and the stop wall 111 define a receiving channel 11. A blade 3 can be fitted into the receiving channel 11 with the back edge 31 of the blade 3 abutting against the stop wall 111. The grip section 2 includes a left and a right flat arched sections 21. The inner circumferences of the arched sections 21 are formed with waved faces 22 to facilitate holding of the grip section 2. Each arched section 21 defines a space 23, whereby a user's fingers can extend through the spaces 23 with the palm pressing the upper edge of the blade-riding section 1 of the knife-holding assist. Accordingly, when cutting an article with a knife, the knife-holding assist 4 is fitted onto the back of the blade of the knife and a user can hold the handle of a knife with one hand and grip the grip section 2 with the other hand to exert a force onto the upper edge of the blade-riding section 1 so as to facilitate cutting operation. Moreover, the flat arched sections 21 encompass the fingers of the user and protect the fingers from slipping away and getting hurt. Therefore, the knife-holding assist of the present invention not only assists a user in cutting an article with a knife, but also protects the fingers of the user and ensures safety in cutting operation.

The above embodiment is only used to illustrate the present invention, not intended to limit the scope thereof. Many modifications of the above embodiment can be made without departing from the spirit of the present invention.

What is claimed is:

1. Knife-holding assist comprising a blade-riding section and a grip section formed on two lateral sides of the blade-riding section, the blade-riding section having a U-shaped cross-section and including a pair of opposite plate bodies connected with each other, the plate bodies defining a receiving channel, whereby a blade of a knife can be fitted into the receiving channel with the back edge of the blade abutting against the bottom of the receiving channel, the grip section including two flat arched sections in form of a ring, whereby a user's hand can grip the grip section with the user's fingers extending into the spaces defined by the arched sections and with the user's palm pressing an upper edge of the blade-riding section to facilitate cutting operation.

2. Knife-holding assist as claimed in claim 1, wherein the pair of opposite plate bodies are connected with each other by a stop wall as the bottom of the receiving channel, whereby after the blade is fitted into the receiving channel, the back edge of the blade abuts against the stop wall.

3. Knife-holding assist as claimed in claim 1, wherein the inner circumferences of the arched sections are formed with waved faces to facilitate holding of the grip section.

* * * * *